US008095999B2

(12) United States Patent
Wilson et al.

(10) Patent No.: US 8,095,999 B2
(45) Date of Patent: Jan. 17, 2012

(54) SHOULDER SUPPORT FOR SHOWER ACCESSORIES

(75) Inventors: David J. Wilson, New Baltimore, MI (US); Evan Carpenter Crawford, Farmington Hills, MI (US); Jeffrey A. DeBoer, Ann Arbor, MI (US)

(73) Assignee: Aqua Glass Corporation, Adamsville, TN (US)

( * ) Notice: Subject to any disclaimer, the term of this patent is extended or adjusted under 35 U.S.C. 154(b) by 476 days.

(21) Appl. No.: 11/107,391

(22) Filed: Apr. 15, 2005

(65) Prior Publication Data

US 2006/0230523 A1 Oct. 19, 2006

(51) Int. Cl.
*A47K 3/22* (2006.01)

(52) U.S. Cl. ..... 4/605; 4/559; 4/576.1; 4/611; 4/612; 4/614

(58) Field of Classification Search ..... 4/538, 596, 4/611, 612, 614, 559, 560.1, 584, 589, 590, 4/605, 576.1, 610; 52/34–35; 248/251, 264
See application file for complete search history.

(56) References Cited

U.S. PATENT DOCUMENTS 2,196,571 A * 4/1940 Van Gorden ..... 211/123
D274,458 S * 6/1984 Doman ..... D23/305
4,578,832 A * 4/1986 Primucci ..... 4/614
5,022,104 A * 6/1991 Miller ..... 4/610
5,312,179 A * 5/1994 Schlaud et al. ..... 312/242
5,402,842 A * 4/1995 Ruggiero ..... 4/610
5,542,218 A * 8/1996 Rompel ..... 52/34
5,778,463 A * 7/1998 Teckchandani et al. ..... 4/538
5,860,538 A * 1/1999 Duero et al. ..... 248/201
6,138,295 A * 10/2000 Hess ..... 4/558
6,585,203 B1 * 7/2003 Euker ..... 248/200.1
6,588,030 B1 * 7/2003 Wulff ..... 4/605
6,640,354 B2 * 11/2003 Bonack et al. ..... 4/611
2005/0172395 A1 * 8/2005 Helmetsie et al. ..... 4/612
2006/0180722 A1 * 8/2006 Pollack ..... 248/210

* cited by examiner

*Primary Examiner* — Tuan Nguyen

(74) *Attorney, Agent, or Firm* — Carlson Gaskey & Olds, P.C.

(57) ABSTRACT

Shoulder supports extend from a shower enclosure wall and support a shower accessory. The shoulders have an attachment on the side for the shower accessories. The selected shower accessory would have a mating attachment on each of its ends to correspond to two shoulders extending from the enclosure walls. The attachment is preferably a male/female indentation on one of the shoulders and shower accessory and a corresponding attachment on the other. The indentations provide a non-permanent attachment of the shower accessory to the supports so that the chosen accessory may later be removed and replaced if desired.

19 Claims, 2 Drawing Sheets

SHOULDER SUPPORT FOR SHOWER ACCESSORIES

BACKGROUND OF THE INVENTION

The invention relates to a support for retaining shower accessories to a shower wall. More particularly, shoulder supports are formed in a shower wall and support various shower accessories.

Shower enclosures are commonly formed as a solid piece, or several solid pieces that can be joined together on site to form the enclosure without requiring large amounts of sealing. However, the solid wall can make adding in supports for shower accessories difficult.

Users often desire to have shelves, towel racks, mirrors, or other shower accessories added to the interior of the enclosure. Adding accessories after manufacture of the enclosure walls often requires drilling. Drilling creates a joint that must be sealed to prevent water leaking behind the enclosure walls. Alternatively, shower accessories may be attached to enclosure walls with temporary means such as gluing, or suction cups. However, over time the temporary nature of the attachment can lead to retention problems.

To avoid the need for drilling or use of temporary attachments some shower enclosures are manufactured with built in shelves or other accessories. This can be a problem when the selected shower accessory is not what is desired by the user. Additionally, the users needs may change over time and different shower accessories may be desired at different points in time.

A shower enclosure that provides a permanent support for holding shower accessories without requiring drilling or restricting the user to one type of accessory chosen by the manufacturer would be desirable.

SUMMARY OF THE INVENTION

The present invention provides shoulder supports for mounting shower accessories in a shower enclosure. The shoulder supports are preferably molded into the shower enclosure wall such that drilling is not necessary to attach a shower accessory The shoulder supports extend from the shower enclosure wall and provide a top surface and attachment structure on a side. The attachment between the accessory and shoulder is preferably a male/female connection. As disclosed, the shoulder supports have a female indentation and the selected shower accessory has a mating male indentation. Of course, the reverse could be utilized. Preferably the connectors are on each of two ends of the accessory correspond to two shoulders extending from the enclosure walls. The indentations provide a non-permanent attachment of the shower accessory to the shoulder supports so that the chosen accessory may later be removed and replaced if desired. However, the shoulder supports are permanently formed in the walls of the shower enclosure to provide secure support.

The indentations preferably have a non-circular shape to prevent the chosen shower accessory from rotating once attached to a shoulder support.

These and other features of the present invention can be best understood from the following specification and drawings, the following of which is a brief description.

DETAILED DESCRIPTION OF THE PREFERRED EMBODIMENT

Figure 1:
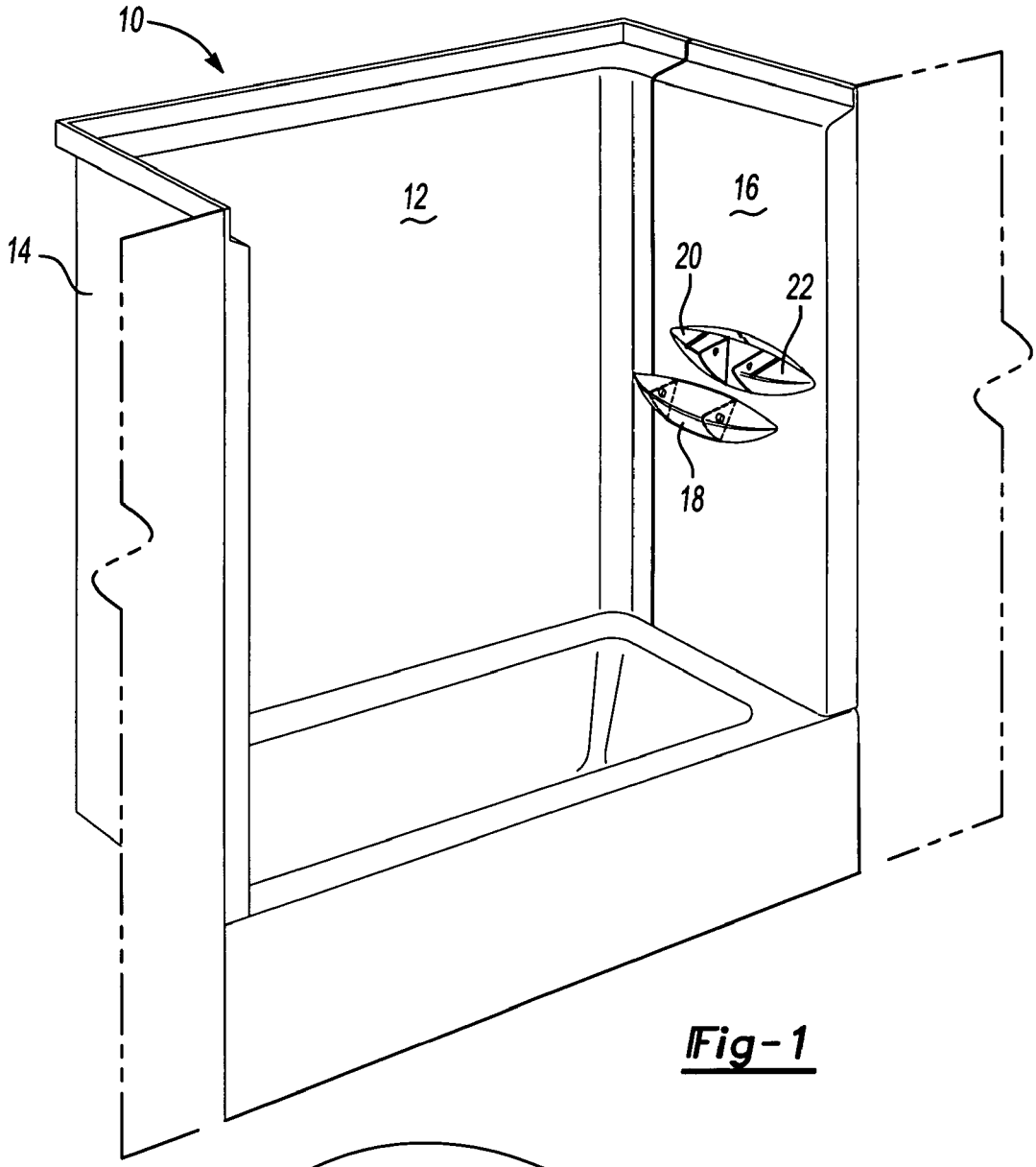
FIG. 1 shows a perspective view of a shower and tub enclosure of the present invention.

FIG. 1 is a perspective view of an enclosure 10 for a tub or shower. The enclosure 10 has a back wall 12, a first side wall 14 and a second side wall 16. The first side wall 14 is a wet wall. That is, it receives the shower and tub faucet, showerhead, etc. The second side wall 16 is a dry wall, the wall opposing the wet wall in the enclosure 10. Together the three pieces form a U-shaped assembly. The open fourth side of the enclosure 10 is used for entering and exiting the tub and shower enclosure 10. Additionally, the fourth side may accommodate a shower door, or curtain.

The enclosure 10 shows a shower accessory 18 attached to the second side wall 16, the dry wall in this embodiment. Although, the shower accessory 18 is shown of the second side wall 16 it may also be placed on the first side wall 14, or the back wall 12. The location of the shower accessory is determined at the time of manufacture of the shower enclosure. In addition, the enclosure can be manufactured to accommodate more than one accessory.

Figure 2:
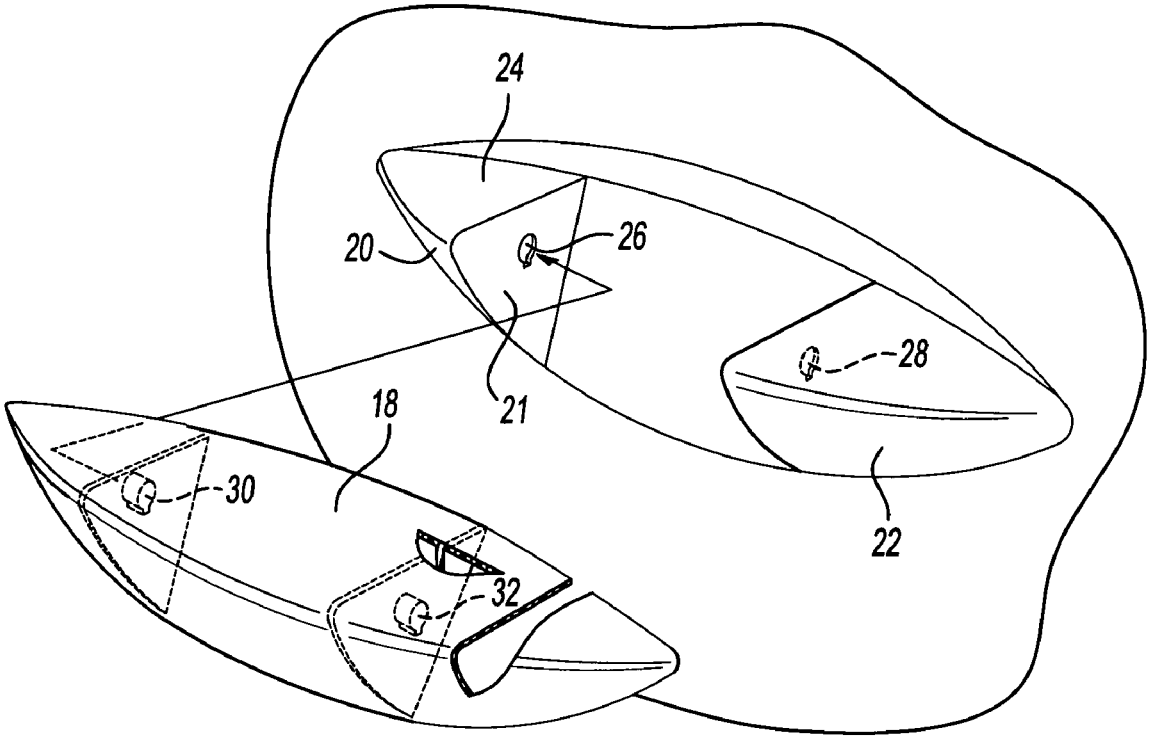
FIG. 2 is an exploded view of the shoulder supports and a shower accessory.

Referring to FIG. 2, a first shoulder 20 and second shoulder 22 are molded with, and extend inwardly from, the second side wall 16. The first shoulder 20 and second shoulder 22 each have a similar shape and accessory attachment structure. For simplicity purposes only the first shoulder 20 is described. In the embodiment shown the first shoulder 20 has a triangular shape in the side view. The top side 24 is relatively flat to provide additional support for the chosen shower accessory 18. The shower accessory 18 in this embodiment is shown as a shelf. Alternatively, the first shoulder 20 and second shoulder 22 could act as end pieces for a towel rack, or support a mirror, shower caddy, etc. Other alternative shower accessories may be used. One skilled in the art would be able to select appropriate alternatives.

The first shoulder 20 has an inner surface 21 with a support opening 26 for attachment of the shower accessory 18. Likewise, the second shoulder 22 has an inner surface 21 and an opening 28. The openings 26 and 28 face each other. The shower accessory 18 has two mating portions 32, one on each opposing end, to correspond to the support openings 26 and 28. Although the embodiment shown discloses a female portion in shoulder supports 20 and 22 and a male portion in shower accessory 18, the female and male portions may be reversed.

A shower accessory 18 may have the configuration shown in FIG. 2. That is, the shower accessory 18 fits over the first and second shoulder supports 20 and 22. The first and second shoulder supports 20 and 22 bear the weight for the shower accessory 18 and any items placed on the shower accessory 18.

Figure 3:
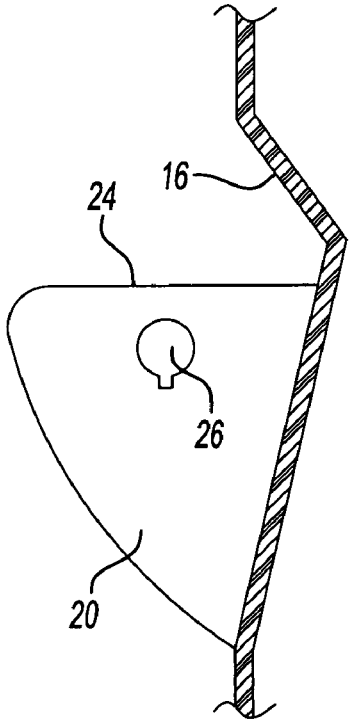
FIG. 3 is end view of a shoulder support showing a keyhole shaped shoulder support for attachment of a distinct shower accessory.

FIG. 3 shows an end view of the first shoulder 20. In this embodiment the opening 26 is a keyhole shaped indentation. Although shown as a keyhole the indentation may take any shape. Preferably a non-circular shape is used to prevent the shower accessory from unnecessarily rotating after it is installed. This is particularly useful when the shower accessory 18 is a circular object, such as the towel rack shown in FIG. 4.

Figure 4:
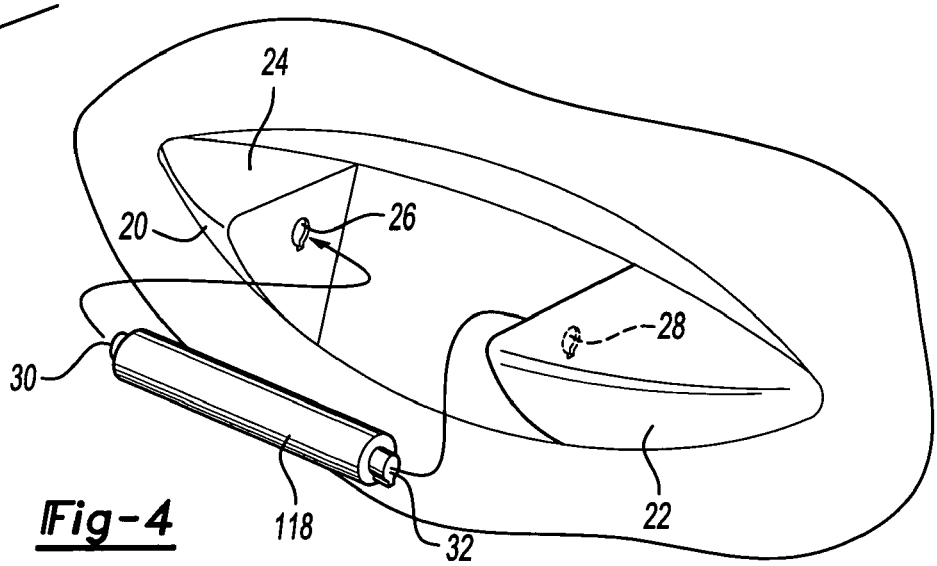
FIG. 4 is a perspective view of another embodiment of the shoulder supports and a shower accessory.

FIG. 4 shows a towel rack 118 that fits between the first shoulder support 20 and the second shoulder support 22. A first mating portion 30 on a first end and a second mating portion 32 on a second end of the towel rack correspond to the first openings 26 and 28 in the first and second shoulder supports 20 and 22. The non-circular shape of openings 26 and 28 prevent rotation of the shower accessory 118. As can be seen in FIG. 4. the first mating portion 30 and second mating portion 32 are non-circular in that each includes a first semi-circular portion that leads into a second polygonal rectangular portion that is dissimilar from the first portion and is narrower than the first portion.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A shower enclosure wall comprising:

a first shoulder molded of and extending from a shower wall, the first shoulder having a first support in a first surface and in plane therewith, a first molded contour made of a second surface that is attached to said first surface;

a second shoulder molded of and extending from said shower wall, the second shoulder being spaced along an axis extending from said first shoulder and having a second support in a third surface and in plane therewith and a second molded contour made of a fourth surface that is attached to said third surface wherein said first surface and said second surface face each other; and wherein said first and second supports have a non-circular cross-section and are parallel to each other and, a first accessory having a first portion extending within said first support and a second portion extending within said second support.

2. The shower enclosure of claim 1, wherein said first and second supports each have a first wide portion that extends into a second narrow portion that is dissimilar to the first portion and that is narrower than the first portion.

3. The shower enclosure of claim 1, wherein said first and second supports are a female indentation.

4. The shower enclosure wall of claim 3, wherein each of said indentations is a keyhole shaped indentation having a first semi-circular portion and a second polygonal portion, the second portion being narrower than the first portion.

5. The shower enclosure wall of claim 3, further comprising a shower accessory that has a first male support on a first end and a second male support on a second end.

6. The shower enclosure wall of claim 5, wherein said shower accessory is a horizontal shelf.

7. The shower enclosure of claim 5, wherein said shower accessory is a towel rack.

8. The shower enclosure of claim 5, wherein said shower accessory is supported on top of said first and said second shoulders above said supports.

9. The shower enclosure wall of claim 1, wherein said shower accessory is a shelf.

10. The shower enclosure of claim 1, wherein said shower accessory is a towel rack.

11. The shower enclosure of claim 1, wherein said shower accessory is receivable at least partially over said first and said second shoulders.

12. The shower enclosure of claim 1, wherein each of the first shoulder and the second shoulder is a triangular protrusion having a triangular top side.

13. The shower enclosure of claim 1, wherein each of the first shoulder and the second shoulder are partially recessed into the shower wall.

14. The shower enclosure of claim 1, wherein each of the first shoulder and the second shoulder are unbridged such that the only permanent connection between the first shoulder and the second shoulder is the shower wall.

15. The shower enclosure of claim 1, wherein said shoulders are non-removable from said shower enclosure wall.

16. The shower enclosure of claim 1, wherein said shoulders form a single continuous surface with said shower enclosure wall.

17. The shower enclosure of claim 1 further comprising a second accessory, said second accessory having a second portion extending within said first support and a second portion extending within said second support.

18. The shower enclosure of claim 17 wherein said second accessory has a third molded contour for mating with said first contour and said second contour.

19. A shower enclosure wall comprising:

a first shoulder molded of and extending from a shower wall, the first shoulder having a first support in a first surface and a first molded contour made of a second surface that is attached to said first surface;

a second shoulder molded of and extending from said shower wall, the second shoulder being spaced along an axis extending from said first shoulder and having a second support in a third surface and a second molded contour made of a fourth surface that is attached to said third surface wherein said first surface and said second surface face each other; and a one piece shower accessory having a third molded contour for mating with said first contour and said second contour, the shower accessory having corresponding mating supports that are interlockable with the respective first support and the second support.

* * * * *